US006390582B1

(12) United States Patent
Laharaty et al.

(10) Patent No.: US 6,390,582 B1
(45) Date of Patent: May 21, 2002

(54) METHOD FOR REDUCING THERMAL AGING IN AN INK JET PRINT HEAD

(75) Inventors: Christopher J. Laharaty, Oregon City; Michele L. Fingerson, Albany; Vernon W. Popham, Tualatin; Ronald F. Burr, Wilsonville, all of OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/250,442

(22) Filed: Feb. 16, 1999

Related U.S. Application Data

(63) Continuation-in-part of application No. 09/170,851, filed on Oct. 13, 1998, now Pat. No. 6,116,712.

(51) Int. Cl.[7] ..... B41J 29/38
(52) U.S. Cl. ..... 347/14
(58) Field of Search ..... 347/14, 9, 60, 347/55, 54, 103, 213, 154, 23, 48, 56, 88, 99, 100, 85, 95

(56) References Cited

U.S. PATENT DOCUMENTS

| | | | |
|---|---|---|---|
| 4,889,560 A | | 12/1989 | Jaeger et al. |
| 5,276,468 A | | 1/1994 | Deur et al. |
| 5,372,852 A | | 12/1994 | Titterington et al. |
| 5,389,958 A | | 2/1995 | Bui et al. |
| 5,422,664 A | | 6/1995 | Stephany |
| 5,635,964 A | | 6/1997 | Burr et al. |
| 5,677,718 A | | 10/1997 | Crawford et al. |
| 5,689,291 A | | 11/1997 | Tence et al. |
| 6,174,095 B1 | * | 1/2001 | Desie et al. |

OTHER PUBLICATIONS

U.S. Patent Application, Apparatus and Method For Drop Size Modulated Ink Jet Printing, SN 09/124,636, Filed Jul. 29, 1998, 28 pages.

U.S. Patent Application, Phase Change Ink Formulation Containing A Combination of a Urethane Resin etc., SN 09/013,410, Filed Jan. 26, 1998, 41 pages.

HP 2000C: The New Emperor of Desktop Color Technology, Cover Story From the Apr. 1998 Issue of The Hard Copy Supplies Journal, Lyra Research Inc, 10 pg.

* cited by examiner

*Primary Examiner*—Raquel Yvette Gordon

(57) ABSTRACT

A method is provided for reducing thermal aging in an ink jet print head while avoiding significant warm-up times. The method selectively utilizes multiple print head standby temperatures to reduce the effects of thermal aging over time. The ink for the printer is a phase change ink. The ink jet printer has a print head, the print head printing at a first print temperature and the print head standing by a different second standby temperature lower than the first print temperature. The ink is ejected from the print head by applying a voltage to a transducer. This method further comprises monitoring the time the printhead is at the second standby temperature, calculating a thermal aging period for the print head at the standby temperature, and at a predetermined value for the thermal aging period, increasing the voltage applied to the transducer when ink is ejected, the voltage being increased at a predetermined rate.

8 Claims, 3 Drawing Sheets

FIG. 3
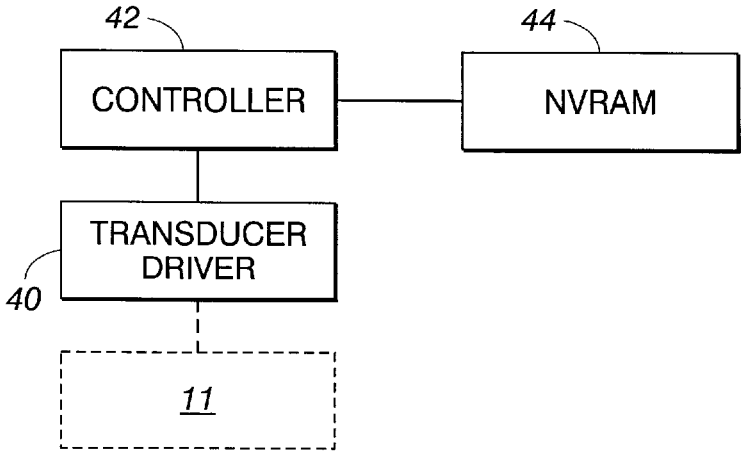
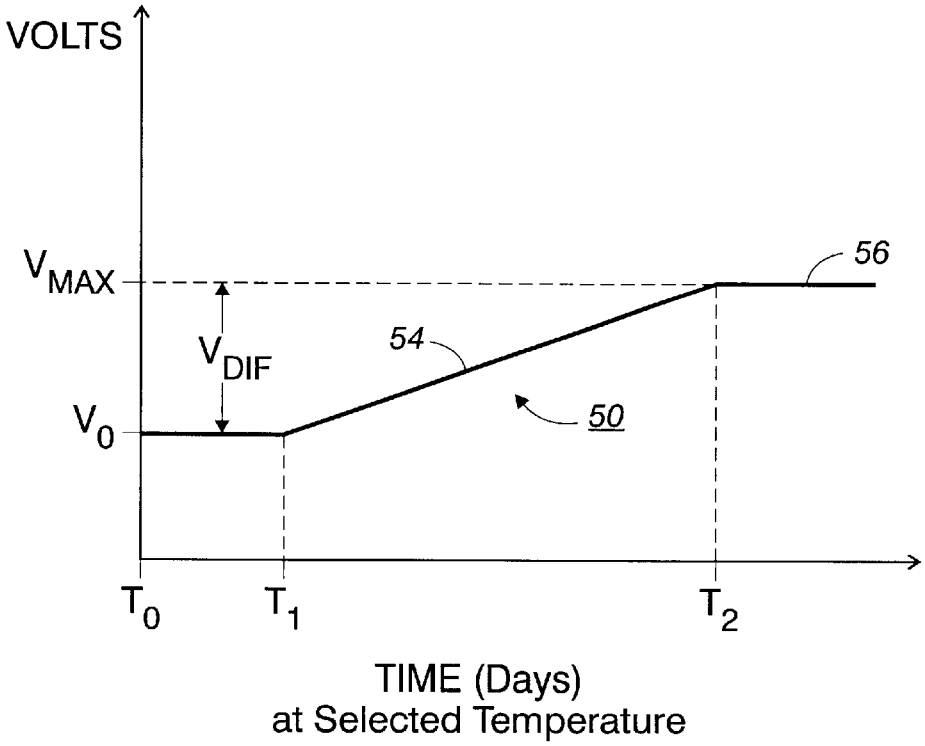
FIG. 4

METHOD FOR REDUCING THERMAL AGING IN AN INK JET PRINT HEAD

CROSS-REFERENCE TO RELATED APPLICATIONS

This application is a continuation-in-part of application Ser. No. 09/170,851, filed Oct. 13, 1998 now Pat. No. 6,116,712.

STATEMENT REGARDING FEDERALLY SPONSORED RESEARCH OR DEVELOPMENT

Not applicable.

FIELD OF INVENTION

This invention relates generally to a method for reducing thermal aging in an ink jet print head and, more specifically, to a method that utilizes multiple print head standby temperatures to reduce the effects of thermal aging without significantly increasing warm-up times.

BACKGROUND OF THE INVENTION

A typical color ink jet print head includes an array of ink jets that are closely spaced from one another for use in ejecting drops of ink toward a receiving surface. The typical print head also has at least four manifolds for receiving black, cyan, magenta and yellow ink for use in monochrome plus subtractive color printing. The number of such manifolds may be varied where a printer is designed to print solely in black ink, gray scale or with less than a full range of color.

In a conventional ink jet print head, each ink jet is paired with an electro mechanical transducer, such as a piezoelectric transducer (PZT). The transducer typically has metal film layers to which an electronic transducer driver is electrically connected. When a voltage is applied across the metal film layers of the transducer, the transducer attempts to change its dimensions. Because it is rigidly attached to a flexible diaphragm, the transducer bends and deforms the diaphragm, thereby causing the outward flow of ink through the ink jet.

Some ink jet print heads, such as phase change ink jet print heads, utilize inks that have melting points of 80° C. and higher. With many of these inks, optimal jetting occurs at significantly higher temperatures, such as 120° C. and above. Consequently, during printing the ink jets and other print head components must be maintained at or above these elevated jetting temperatures. The temperature of the ink reservoirs supplying liquid ink to the ink jets must also be maintained at or near the required jetting temperatures.

Prolonged use of an ink jet print head at elevated temperatures can alter print head performance and accelerate thermal stress or aging of the print head components. This can result in image degradation due to performance variations. For example, the drop mass of ejected ink drops can vary as the print head components are thermally conditioned over time. The positioning of the ejected ink drops on the receiving surface can also vary with thermal conditioning.

To reduce thermal stress experienced by the print head, and for energy conservation purposes, it is desirable to minimize the amount of time the print head experiences elevated temperature. In the past this need has been addressed by utilizing a single "standby" mode in which the temperatures of the print head and the ink reservoir are reduced to well below the operating temperature at selected times when the printer is not in use. For example, in the Phaser® 360 solid ink color printer manufactured by Tektronix, Inc., the assignee of the present application, the temperature of the print head during printing and in the "ready" condition between print jobs is about 140° C. The printer remains in the ready condition for about four hours, and after this period enters a standby condition. In the standby condition the temperature of the print head is about 102° C. and the temperature of the ink reservoirs is about 98° C.

When a print head and ink reservoir are in a standby condition, the printer must raise the temperature of the print head and ink reservoir back to the operating temperature before printing can begin. This imposes an undesirable delay on the printing process. For example, the Phaser® 360 printer can require approximately five minutes to raise the temperatures of the print head and ink reservoirs from the standby condition to the operating condition.

The present invention provides a method for reducing thermal aging in an ink jet print head while avoiding significant warm-up times. The method selectively utilizes multiple print head standby temperatures to reduce the effects of thermal aging over time and minimize warm-up delays.

SUMMARY OF THE INVENTION

It is an aspect of the present invention to provide a method for reducing thermal aging in an ink jet print head.

It is a feature of the present invention that the method reduces thermal aging without significantly increasing warm-up times.

It is another feature of the present invention that the method utilizes multiple standby conditions corresponding to multiple temperatures in the print head and ink reservoirs.

It is an advantage of the present invention that the method increases print head life by reducing the average temperature the print head experiences over its lifetime.

Still other aspects of the present invention will become apparent to those skilled in this art from the following description, wherein there is shown and described a preferred embodiment of this invention by way of illustration of one of the modes best suited to carry out the invention. The invention is capable of other different embodiments and its details are capable of modifications in various, obvious aspects all without departing from the invention. Accordingly, the drawings and descriptions will be regarded as illustrative in nature and not as restrictive. And now for a brief description of the drawings.

BRIEF DESCRIPTION OF THE SEVERAL VIEWS OF THE DRAWINGS

FIG. 3 is a schematic diagram showing the printer controller controlling a transducer driver that supplies voltage to the PZT in the ink jet, and the controller in communication with an NVRAM memory source.

FIG. 4 is a graph of a voltage compensation curve with the Y-axis indicating the voltage supplied to the transducer and the X-axis indicating the thermal aging period of the print head expressed in time (DAYS) at a selected temperature.

Reference will now be made in detail to the present preferred embodiment of the invention, an example of which is illustrated in the accompanying drawings.

DETAILED DESCRIPTION OF THE PREFERRED EMBODIMENT

Figure 1:
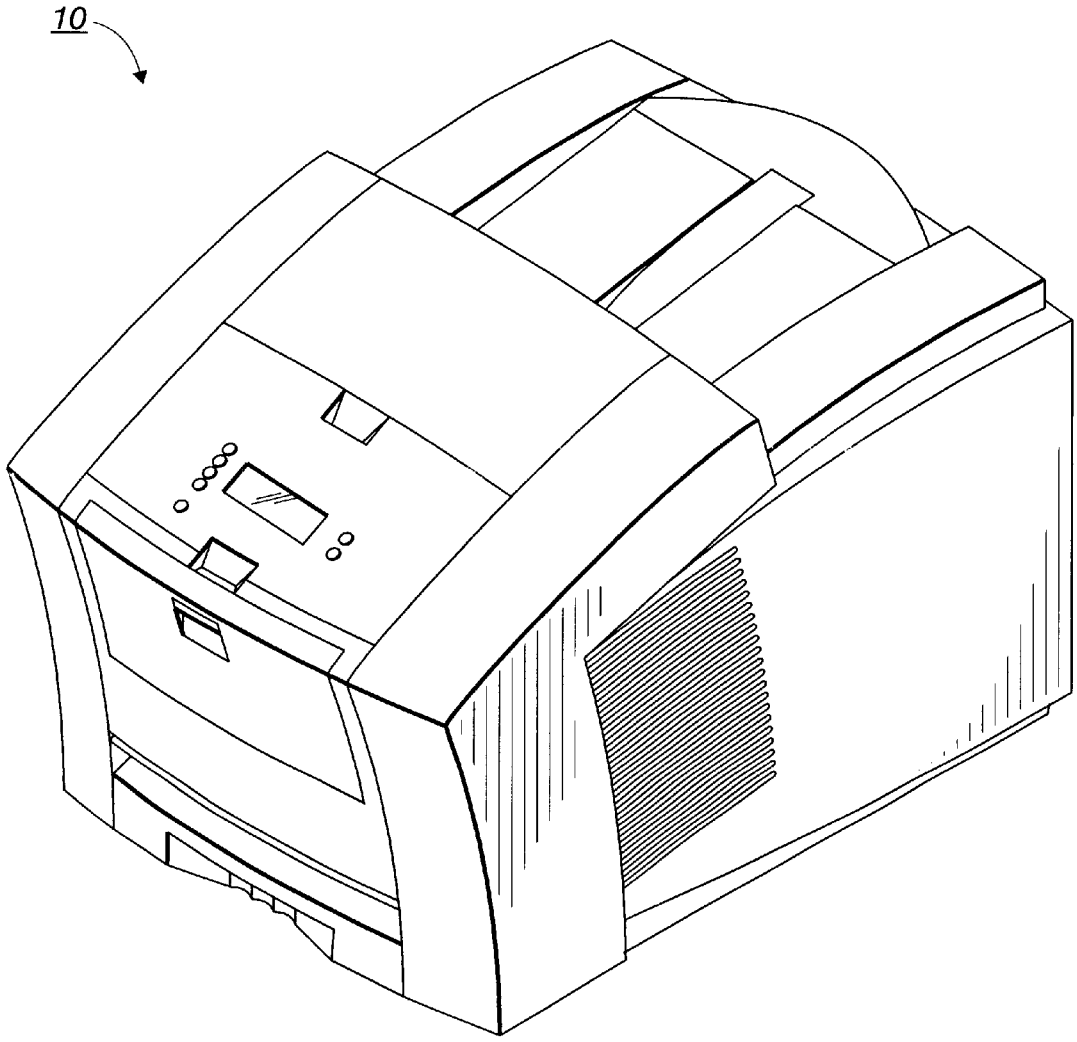
FIG. 1 is an overall perspective view of an ink jet printer that uses the method of the present invention.

FIG. 1 is an overall perspective view of a phase change ink jet printing apparatus, generally indicated by the reference numeral 10, that utilizes the method of the present invention. It will be appreciated that the present invention may be practiced with and embodied in various other imaging apparatus that utilize an ink jet print head, such as aqueous ink jet printers and the like. Accordingly, the following description will be regarded as merely illustrative of one embodiment of the present invention.

Figure 2:
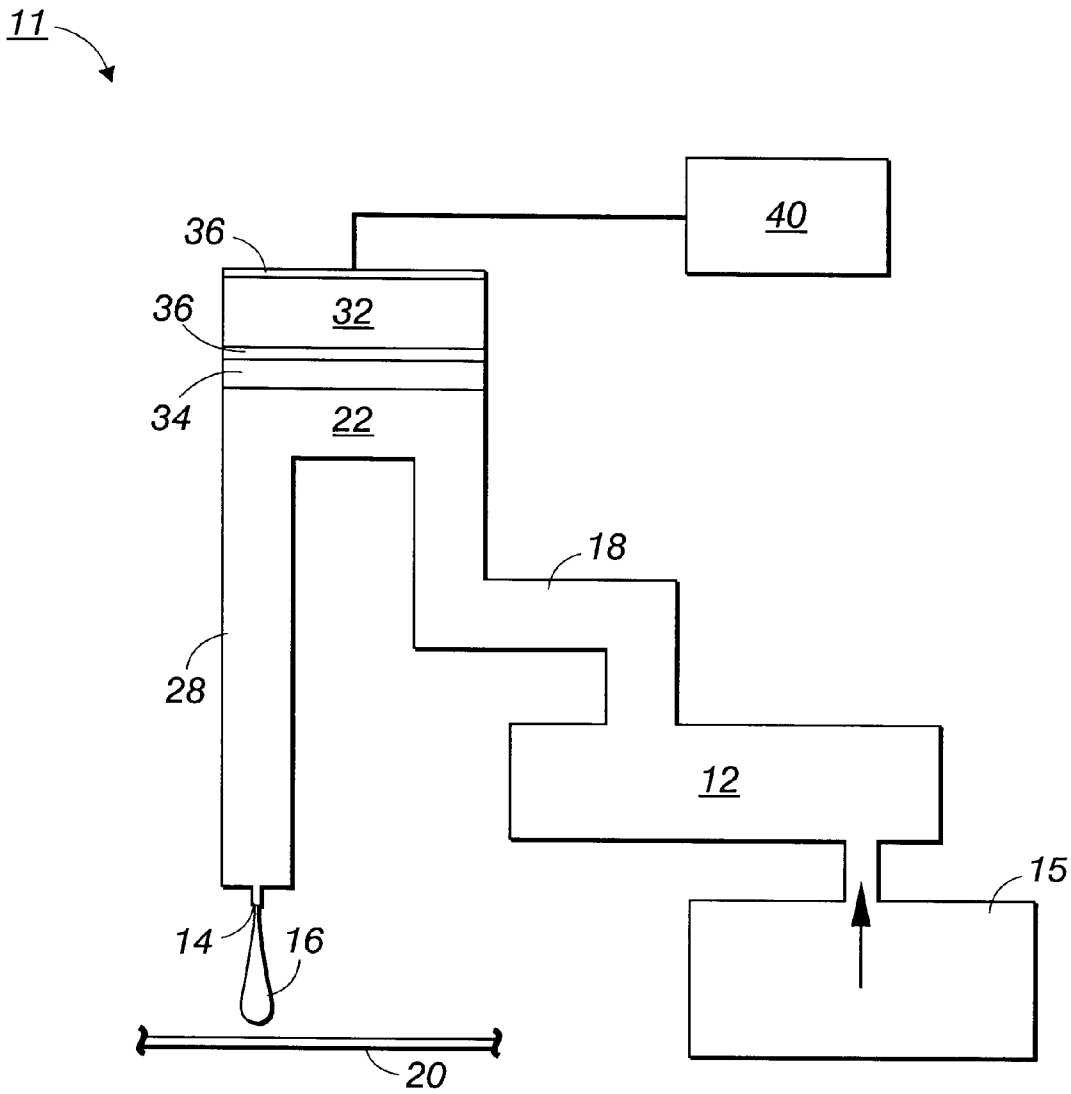
FIG. 2 is an enlarged schematic view of a preferred PZT driven ink jet suitable for use with this invention.

FIG. 2 shows a schematic illustration of an individual ink jet 11. The ink jet 11 is a part of a multiple-orifice ink jet print head contained in the printer 10. Ink jet 11 includes an ink manifold 12 that receives molten or liquid ink from a reservoir 15. Ink flows from manifold 12 through an inlet channel 18 into an ink pressure chamber 22. Ink flows from the pressure chamber 22 into an outlet channel 28 to the ink drop forming orifice 14, from which an ink drop 16 is ejected toward a receiving surface 20. In one embodiment, the receiving surface 20 comprises an intermediate transfer surface, such as a sacrificial liquid layer on a drum. The ink is jetted onto the liquid layer to form an ink image. The ink image is then transferred to a final receiving surface, such as a sheet of paper.

A more detailed description of this type of printing apparatus is disclosed in U.S. Pat. No. 5,389,958 entitled IMAGING PROCESS (the '958 patent) and U.S. Pat. No. 5,276,468 entitled METHOD AND APPARATUS FOR PROVIDING PHASE CHANGE INK TO AN INK JET PRINTER (the '468 patent), both patents assigned to the assignee of the present application. The '958 and '468 patents are incorporated by reference in their entirety. The method of the present invention may also be practiced with other printer architectures, such as direct printing architectures in which the ink is jetted directly onto a final receiving surface.

The ink pressure chamber 22 is bounded on one side by a flexible diaphragm 34. An electro mechanical transducer 32, such as a piezoelectric transducer (PZT), is secured to diaphragm 34 by an appropriate adhesive and overlays ink pressure chamber 22. The transducer mechanism 32 can comprise a ceramic transducer bonded with epoxy to the diaphragm plate 34, with the transducer centered over the ink pressure chamber 22. The transducer may be substantially rectangular in shape, or alternatively, may be substantially circular or disc-shaped. In a conventional manner, transducer 32 has metal film layers 36, such as gold or nickel layers, to which an electronic transducer driver 40 is electrically connected.

The transducer 32 described with the preferred embodiment is a bending-mode transducer. Transducer 32 is operated in its bending mode such that when a voltage is applied across metal film layers 36, transducer 32 attempts to change its dimensions. Because it is securely and rigidly attached to diaphragm 34, transducer 32 bends and deforms diaphragm 34, thereby displacing ink in ink pressure chamber 22 and causing the outward flow of ink through outlet channel 28 to nozzle 14. Refill of ink pressure chamber 22 following the ejection of an ink drop is accomplished by reverse bending of transducer 32 and the resulting movement of diaphragm 34. It will be appreciated that other types and forms of transducers may also be used, such as shear-mode, annular constrictive, electrostrictive, electromagnetic or magnetostrictive transducers.

Ink jet 11 may be formed from multiple laminated plates or sheets, such as sheets of stainless steel, that are stacked in a superimposed relationship. An example of a multiple-plate ink jet is disclosed in U.S. Pat. No. 5,689,291 entitled METHOD AND APPARATUS FOR PRODUCING DOT SIZE MODULATED INK JET PRINTING, and assigned to the assignee of the present application. U.S. Pat. No. 5,689,291 is specifically incorporated by reference in its entirety. It will be appreciated that various numbers and combinations of plates may be utilized to form the ink jet 11 and its individual components and features persons skilled in the art will also recognize that other modifications and additional features may be utilized with this type of ink jet to achieve a desired level of performance and/or reliability. For example, acoustic filters may be incorporated into the ink jet to dampen extraneous and potentially harmful pressure waves. The positioning of the manifolds, pressure chambers and inlet and outlet channels in the print head may also be modified to control ink jet performance.

The ink jet 11 is preferably designed to operate with phase change ink. Conventional phase change ink is initially solid at room temperature and is changed to a molten state by the application of heat energy to raise its temperature to between about 85° C. and about 150° C. For optimal jetting through an ink jet print head, the ink is maintained at a jetting temperature of between about 120° C. and about 150° C.

An exemplary phase change ink is comprised of a phase change ink carrier composition admixed with a phase change ink compatible colorant. The phase change ink carrier composition comprises an admixture of (1) at least one urethane resin; and/or (2) at least one mixed urethane/urea resin; and (3) at least one mono-amide; and (4) at least one polyethylene wax. A more detailed description of a phase change ink is found in co-pending U.S. patent application Ser. No. 09/013,410 ("the '410 application") entitled PHASE CHANGE INK FORMULATION CONTAINING A COMBINATION OF A URETHANE RESIN, A MIXED URETHANE/UREA RESIN, A MONO-AMIDE AND A POLYETHYLENE WAX, filed Jan. 26, 1998 and assigned to the assignee of the present application. The '410 application is hereby specifically incorporated by reference in its entirety.

It will be appreciated that many other types of inks having various compositions, including but not limited to phase change and aqueous inks, may be utilized with the present invention. Examples of suitable alternative phase change inks are described in U.S. Pat. Nos. 4,889,560 (the '560 patent) and 5,372,852 (the '852 patent). The '560 patent and '852 patent are hereby specifically incorporated by reference in their entirety. The inks disclosed in these patents consist of a phase change ink carrier composition comprising one or more fatty amide-containing materials, preferably consisting of a mono-amide wax and a tetra-amide resin, one or more tackifiers, one or more plasticizers and one or more antioxidants, in combination with compatible colorants.

When the ink jet printer 10 is in a printing or ready condition, the print head and ink jet 11 are maintained at the optimal jetting temperature for the phase change ink being used. For example, when the printer 10 utilizes a phase change ink as described in the '560 and '852 patents, the ink jet 11 may be maintained at an ink jet operating temperature of between about 120° C. and about 150° C., and more preferably about 140° C. The reservoir 15 that supplies liquid ink to the print head may also be maintained at a reservoir operating temperature of between about 123° C. and about 143° C., and more preferably about 133° C.

The printer 10 may also enter other status conditions in which the print head is maintained at a temperature lower than the ink jet operating temperature. For example, the printer 10 may enter a printer standby condition after a predetermined amount of time has elapsed without a print command or other operation. In one embodiment of the printer standby condition utilizing a phase change ink as described in the '560 and '852 patents, the print head is maintained at an ink jet standby temperature of between about 94° C. and about 110° C., and preferably about 104° C. The reservoir is maintained at a reservoir standby temperature of between about 92° C. and about 112° C., and more preferably about 102° C.

In an important aspect of the present invention, the printer 10 may also utilize other standby conditions that maintain the print head at a temperature closer to but still lower than the required jetting temperature. For example, initially the reservoir may be maintained at a reservoir standby temperature and the ink jet maintained at an ink jet standby temperature. When a print request or other command is received, the reservoir is heated to the reservoir operating temperature and the ink jet heated to the ink jet operating temperature to ready the printer for printing. After the reservoir and ink jet are maintained at their respective operating temperatures for a first period of time, such as at least 15 minutes, during which a print request or other command is not received, the printer may initially enter a jet stack standby condition. In one embodiment of the jet stack standby condition the ink jet is cooled to a jet stack standby temperature of between about 104° C. and about 124° C., and preferably about 114° C., while the reservoir is maintained at the reservoir operating temperature.

Advantageously, utilizing a jet stack standby temperature that is below the ink jet operating temperature reduces the thermal stress in the print head. This reduction in thermal stress extends the useful life of the print head. Additionally, because the jet stack standby temperature is closer to the ink jet operating temperature than the ink jet standby temperature, the time required to heat the ink jet from the jet stack standby temperature to the ink jet operating temperature is less than the time required to heat the ink jet from the ink jet standby temperature to the ink jet operating temperature. In one embodiment utilizing a jet stack standby temperature of about 114° C., the time required to heat the print head from the jet stack standby temperature to the ink jet operating temperature of about 140° C. is about 110 seconds. Further, because the reservoir is maintained at the reservoir operating temperature, there is no delay required to heat the reservoir to its operating temperature.

The printer may remain in the jet stack standby condition for a second period of time, such as between about 30 minutes and about 240 minutes. After this second period of time, the reservoir may be cooled to its reservoir standby temperature. To further reduce thermal stress in the print head, the ink jet 11 may also be cooled to its ink jet standby temperature after the second period of time has elapsed.

In another embodiment of the present invention, the reservoir is initially maintained at a reservoir standby temperature and the ink jet maintained at an ink jet standby temperature. When a command is received for the printer to enter a modified ready condition, the reservoir is heated to the reservoir operating temperature and the ink jet heated to the jet stack standby temperature. The printer remains in this modified ready condition until a print command is received. When a print command is received, the temperature of the jet stack is then raised to the ink jet operating temperature to enable printing to occur. Advantageously, in this embodiment the modified ready condition maintains the ink jet at the jet stack standby temperature, as opposed to the ink jet operating temperature, until a print command is received. This further reduces thermal stress on the print head and extends the life of the print head.

In another embodiment of the jet stack standby condition, the reservoir temperature may be held within a reservoir standby range of between about 104° C. and about 124° C., while the temperature of the ink jet 11 is lowered to the preferred ink jet standby temperature of 104° C. After a predetermined amount of time in this jet stack standby condition, such as one hour, the temperatures of the reservoir 15 and ink jet 11, if necessary, are lowered to their respective standby temperatures.

As illustrated in FIG. 3, a controller 42 in the printer 10 controls the operation of the transducer driver 40. The controller 42 also monitors the print head in its various operating and standby conditions to track a total time during which the print head experiences a plurality of temperatures. As mentioned above, prolonged use of a PZT-driven ink jet print head at elevated temperatures can alter the performance of the transducer and/or other ink jet components. For example, thermal conditioning of the ink jet over time can cause variations in the drop mass of the ejected ink drops. The positioning of the ejected ink drops on the receiving surface can also vary with thermal aging.

To reduce ink drop mass variations and drop positioning errors due to thermal conditioning, the controller 42 monitors and calculates a thermal aging period of the print head. When the thermal aging period reaches a first predetermined value, the controller 42 alters the voltage supplied to the transducer 32 by the transducer driver 40 to compensate for drop mass variations due to thermal conditioning.

In one embodiment, the thermal aging period is defined as the period of time during which the print head experiences at least a selected temperature. In this embodiment, the controller 42 monitors the time that the print head is in an operating or printing mode, corresponding to a selected temperature of between about 120° C. and about 150° C., and preferably about 140° C. With reference now to FIG. 4, the accumulated time that the print head experiences at least the selected temperature is plotted on a voltage compensation curve 50. The time or thermal aging period along the horizontal axis is measured in calendar days/24 hour periods (DAYS) during which the print head experiences at least the selected temperature. The vertical axis defines the voltage supplied to the transducer 32. At time $T_0$ the transducer 32 initially receives a voltage waveform with a peak voltage corresponding to $V_0$. The peak voltage remains constant at $V_0$ until the time at the selected temperature (thermal aging period) equals a first value $T_1$. Preferably, $T_1$ is about 140 calendar days. It will be appreciated that the value of $T_1$ may be varied to suit the performance characteristics of a particular print head or to achieve a desired drop mass consistency.

When the thermal aging period reaches $T_1$, the controller 42 begins increasing the voltage supplied to the transducer 32 as the thermal aging period increases. In the preferred embodiment, the voltage is increased at a linear rate indicated by the sloping portion 54 of the curve 50 preferably, the voltage is increased at a rate or slope of between about 0.001 Volts/DAY and about 0.015 Volts/DAY, and more preferably at about 0.008 Volts/DAY, where DAY=$D_{PT}$, and $D_{PT}$ is defined as calendar days during which the print head experiences at least the selected temperature. This linear increase in voltage from the initial $V_0$ value continues as the thermal aging period increases until a maximum differential voltage $V_{DIF}$ has been added to the initial Voltage $V_0$. In a preferred embodiment, the maximum differential voltage $V_{DIF}$ is between about 2.0 Volts and about 4.0 Volts. With reference to the horizontal portion 56 of the curve 50, after the maximum differential Voltage $V_{DIF}$ has been reached at time $T_2$, the voltage remains constant at a value $V_{MAX}$ as the thermal aging period continues.

In another embodiment, the controller 42 also monitors the time that the print head experiences other temperatures, such as when the print head is in a printer standby or a jetstack standby condition. In this embodiment the thermal aging period is defined as a period of time during which the print head experiences the selected temperature, the printer standby temperature or the jetstack standby temperature.

To account for the thermal conditioning experienced by the print head during the printer standby and jetstack standby conditions, the controller 42 converts the time at these lower standby temperatures to time at the selected or operating temperature. To accomplish this conversion, the controller multiplies the time in each standby mode by a scaling factor. In the preferred embodiment, the time in the printer standby mode $D_{PS}$ is expressed in calendar days during which the print head experiences the printer standby temperature. This time is converted to $D_{PT}$ calendar days at the selected temperature by multiplying it by a printer standby scaling factor $F_{PS}$. Similarly, the time in the jetstack standby mode $D_{JS}$ is expressed in calendar days during which the print head experiences the jetstack standby temperature. This value is converted to $D_{PT}$ calendar days at the selected temperature by multiplying $D_{JS}$ by a jetstack standby scale factor $F_{JS}$. Preferably, both scaling factors $F_{PS}$ and $F_{JS}$ have a value of about 0.145. With reference again to FIG. 4 and utilizing these scaling factors, the value in DAYS of a coordinate along the horizontal axis may be expressed as $DAY=D_{PT}+[(D_{PS})^* (F_{PS})]+[(D_{JS})^*(F_{JS})]$.

With reference now to FIG. 3, a non-volatile memory source 44 (NVRAM) is used to store the thermal aging period information corresponding to the amounts of time during which the print head is in the various modes of operation and standby. This thermal aging period information is updated whenever the printer changes status conditions, such as when a print command is received or when the printer enters one of the standby modes. In the preferred embodiment, the thermal aging period information in the NVRAM 44 is also updated at least every five minutes when the status condition of the printer has not changed.

In an additional embodiment, multiple operating or printing modes may be utilized for ejecting different drop masses. The voltage compensation curve 50 may then be adjusted for each mode to optimize the voltage compensation for each mode. For example, the printer 10 may utilize first, second and third printing modes that eject ink drops having three different drop masses. For each of the three printing modes, the selected temperature remains at about 140° C. and the time $T_1$ is about 140 DAYS. For the first printing mode, a maximum differential voltage $V_{DIF}$ is about 3.0 Volts and the slope of the sloping portion 54 of the voltage compensation curve 50 is about 0.008 Volts/DAY. For the second and third printing modes, a maximum differential voltage $V_{DIF}$ is about 2.5 Volts and the slope of the sloping portion 54 of the curve 50 is about 0.007 Volts/DAY.

An ink jet printer according to the present invention includes a print head having multiple ink jets 11 as described above. Examples of an ink jet print head and an ink jet printer architecture are disclosed in U.S. Pat. No. 5,677,718 entitled DROP-ON-DEMAND INK JET PRINT HEAD HAVING IMPROVED PURGING PERFORMANCE (the '718 patent) and in the '958 patent mentioned above, both patents assigned to the assignee of the present application. The '718 patent and the '958 patent are specifically incorporated by reference in their entirety. It will be appreciated that other ink jet print head constructions and ink jet printer architectures may be utilized in practicing the present invention. The method of the present invention may also be practiced to jet various fluid types including, but not limited to, aqueous and phase-change inks of various colors.

The foregoing description of a preferred embodiment of the invention has been presented for purposes of illustration and description. It is not intended to be exhaustive or to limit the invention to the precise form disclosed. The terms and expressions which have been employed in the foregoing specification are used therein as terms of description and not of limitation. The use of such terms and expressions is not intended to exclude equivalents of the features shown and described or portions thereof. Many changes, modifications, and variations in the materials and arrangement of parts can be made, and the invention may be utilized with various different printing apparatus, other than solid ink offset printers, all without departing from the inventive concepts disclosed herein. The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when the claims are interpreted in accordance with breadth to which they are fairly, legally, and equitably entitled. All patents cited herein are incorporated by reference in their entirety.

What is claimed is:

1. A method of operating an ink jet printer, wherein the ink for the printer is a phase change ink, and wherein the ink jet printer has a print head, the print head printing at a first print temperature and the print head standing by at a different second standby temperature lower than the first print temperature, and wherein the ink is ejected from the print head by applying a voltage to a transducer, the method comprising, monitoring the time the print head is at the second standby temperature, calculating a thermal aging period for the print head at the standby temperature, and at a predetermined value for the thermal aging period, increasing the voltage applied to the transducer when ink is ejected, the voltage being increased at a predetermined rate.

2. The method of claim 1 where the value of the predetermined thermal aging period is about 140 calendar days.

3. The method of claim 1 where the rate of increase of the voltage applied to the transducer is between about 0.001 volts per day and about 0.015 volts per day.

4. A method of operating an ink jet printer, wherein the ink for the printer is a phase change ink, and wherein the ink jet printer has a print head, the print head printing at a first print temperature and the print head standing by at a second different standby temperature lower than the first print temperature, and wherein the ink is ejected from the print head by applying a voltage to a transducer, the method comprising, monitoring the time the print head is at the first print temperature, calculating a standby thermal aging period for the first print at the print temperature, monitoring the time the print head is at the second standby temperature, calculating a print aging period for the print head at the second standby temperature, combining the print and standby thermal aging periods to determine a total thermal aging period, at a predetermined value for the total thermal aging period, increasing the voltage applied to the transducer when ink is ejected, the voltage being increased at a predetermined rate.

5. The method of claim 4 where the value of the predetermined total thermal aging period is about 140 calendar days.

6. The method of claim 4 where the rate of increase of the voltage applied to the transducer is between about 0.001 volts per day and about 0.015 volts per day.

7. A method of operating an ink jet printer, wherein the ink for the printer is a phase change ink, and wherein the ink jet printer has a print head, the print head printing at a first print temperature and the print head standing by at a different second standby temperature lower than the first print temperature, and wherein the ink is ejected from the print head by applying a voltage to a transducer, the method comprising, monitoring the time the print head is at the second standby temperature, calculating a thermal aging period for the print head at the standby temperature, and at a predetermined value for the thermal aging period, increasing the voltage applied to the transducer when ink is ejected, the voltage being increased at a predetermined rate, at a second predetermined value for the thermal aging, the value being greater than the first predetermined value for the thermal aging, applying a constant voltage to the transducer when ink is ejected, the voltage being higher than the voltage at which is applied at the first predetermined value for the thermal aging.

8. The method of claim 7 wherein the difference between the constant voltage applied to the transducer at the second predetermined value and the voltage applied to the transducer at the first predetermined value is less than about 2 volts.

* * * * *